US005605378A

United States Patent [19]

Oyediran

[11] Patent Number: 5,605,378

[45] Date of Patent: Feb. 25, 1997

[54] TAKE-APART CHAIR

[76] Inventor: Badejo A. Oyediran, 1705 Mansion St., Bronx, N.Y. 10460

[21] Appl. No.: 578,463

[22] Filed: Dec. 26, 1995

[51] Int. Cl.[6] ..... A47C 4/02

[52] U.S. Cl. ..... 297/440.13

[58] Field of Search ..... 297/440.13, 440.23; 248/174; 108/165, 180

[56] References Cited

U.S. PATENT DOCUMENTS

| | | | |
|---|---|---|---|
| 2,518,955 | 8/1950 | Stelzer | 297/440.13 |
| 2,534,413 | 12/1950 | Cenis | 297/440.13 |
| 2,551,071 | 5/1951 | Tyng | 297/440.13 X |
| 2,632,498 | 3/1953 | Curtis | 297/440.13 |
| 3,262,405 | 7/1966 | Sutton | 297/440.13 X |
| 4,509,794 | 4/1985 | Roland | 297/440.13 |
| 5,387,027 | 2/1995 | Maloney | 297/440.13 |

*Primary Examiner*—Peter R. Brown
*Attorney, Agent, or Firm*—Thomas H. Whaley

[57] ABSTRACT

A "take apart chair" is disclosed which may be constructed from different types of wood, plastic, laminated fiberboard, or aluminum, to form a sturdy and attractive piece of furniture. The chair comprises only of five parts which are easily assembled without the need of tools or detachable gadgets. The chair may be easily and quickly disassembled for storage and shipment.

2 Claims, 3 Drawing Sheets

TAKE-APART CHAIR

This invention relates to a "Knock- Down" chair which can be easily assembled without the need for tools, or detachable gadgets. In one of its more specific aspects, this invention relates to a chair which can be made principally of different types of wood and plywood, plastic, laminated fiberboard, and aluminum or the like with minimal waste.

There have been a number of inventions made with the objective of making furniture more elegant, efficient, multi-functional, and easy-to-store for the home and office. Many types that are either "knockdown", collapsible, or "disconnecting" have some deficiencies that can be troublesome.

It is an object of this invention to provide chairs possessing efficient storage options; something lacking in most prior art chairs.; for example, U.S. Pat. No. 4,209,198 and U.S. Pat. No. 4,254,992. Both devices consist of members that are very large and awkward, thus limiting there storage options. The chair disclosed herein consist of five members all of which may be made of ⅝" thick specified sheet material; for example, ⅝ inch thick plywood, plastic, laminated fiberboard, aluminum or the like. The sizes and thickness of each member allows for storage in a number of informal spaces; for example, underneath a bed or sofa, on top of shelves, or in small closets. The elliptical cut-out portions on the members also allows them to be hung on hooks. In addition, they make the chair of this invention lighter in weight.

It is a further object of the chair of this invention to be ergonomically correct. Products similar to the proposed invention, and most chairs in general are poorly designed for relieving strain on certain body parts; thus not performing one of the important purposes of a chair. Long term use of these chairs may result in back pain and spinal deformities. The frame members of the chair of this invention have been angled to relieve pressure on the neck, shoulders, back, and legs. A cushion on the seat member is preferably provided which gives more comfort to the buttocks and hamstring area. The seat member may also be used as a floor cushion or the like. These considerations will allow for many hours of sitting comfort.

It is another objective of the invention to provide an elegant piece of furniture for the home, restaurant, office or the like spaces. The strong angular forms joined with the elliptical cut-out forms of each member makes the chair of my invention an object of strong character and elegance.

The present invention consist of a chair which can be made of almost any structurally strong sheet material; for example, plywood, oak, maple, etc.; Plastic-high impact injection-molded PVC plastic or fiber glass reinforced plastic; laminated fiberboard; or aluminum -types 2024- T4 or 3003-H14. The chair consist in its simplest form five cut-out pieces which may be quickly assembled without the use of or need for tools. The assembled chair of this invention may be easily and quickly disassembled when desired, either for shipping or for storage. When assembled, the chair is sturdy and comfortable to sit in due to its unique design. Approximately a 4 ft. ×4 ft. sheet of any of the specified sheet materials will accommodate the five pieces with minimal waste. Details of its construction and assembly will be apparent from the accompanying drawings and the following detailed description;

FIGS. 1 and 2 of the drawings are perspective views which illustrates left and right side pieces forming the principal supports of the chair when assembled;

Figure 1:
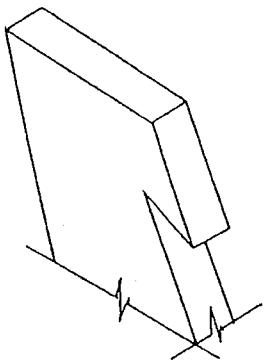
Figure 1:
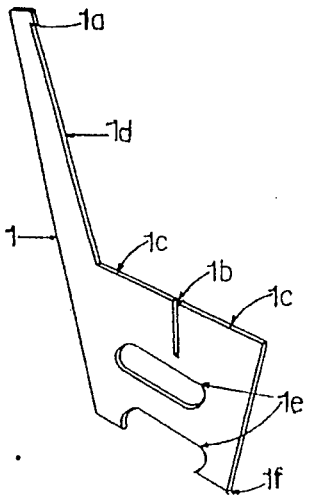
Figure 2:
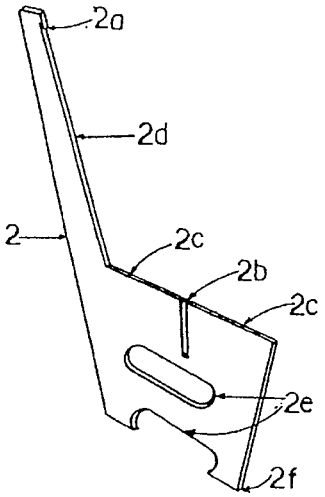

FIG. A1 shows an enlarged view of hooks 1*a* and 2*a* of the FIGS. 1 and 2.

Figure 4:
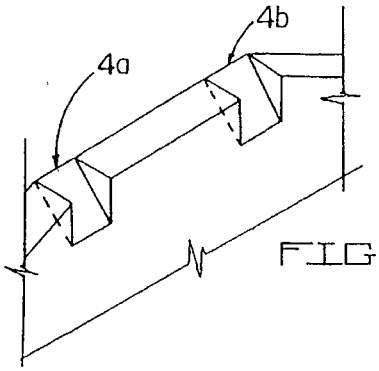
FIG. 4 is a perspective view of the backrest member.
Figure 4:
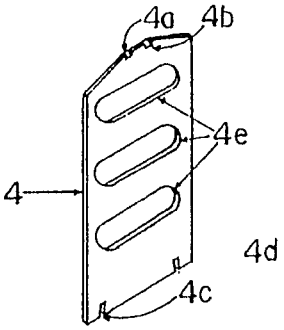

FIG. B1 show an enlarged view of notches 4*a* and 4*b* of FIG. 4.

FIGS. 6 to 14 illustrate graphically the steps involved in assembling the chair.

Figure 15:
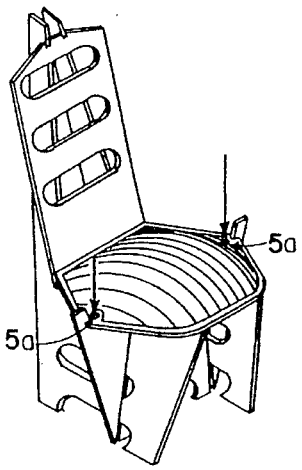

FIG. 15 is a perspective view, of the chair assembled.

Figure 5:
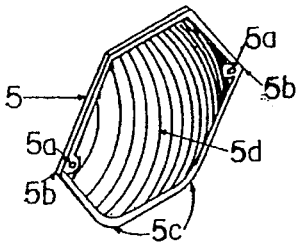
FIG. 5 is a perspective view of the seat member.
Figure 14:
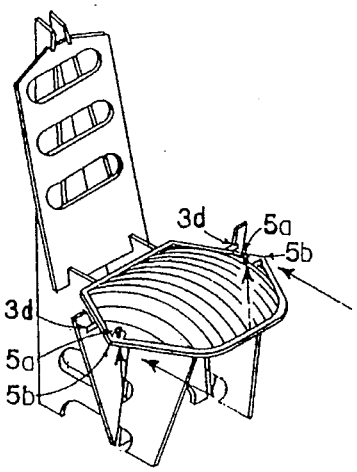

FIGS. A3 are detailed enlargement views of the assembly of non-detachable, pegs (FIG. 5*a*) of FIG. 5 joining brace 3.

Figure 16:
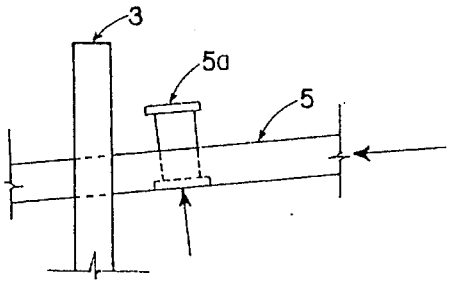
Figure 16:
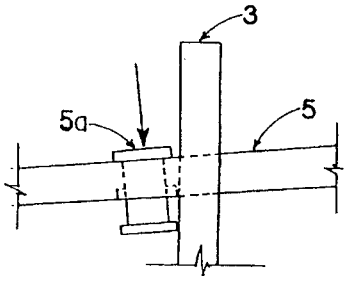
Figure 16:
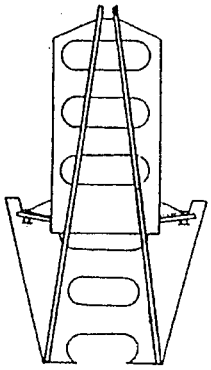
Figure 17:
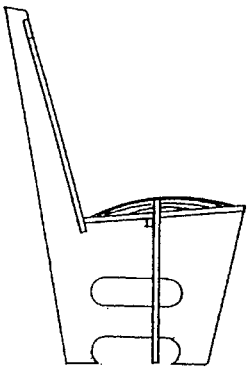
Figure 18:
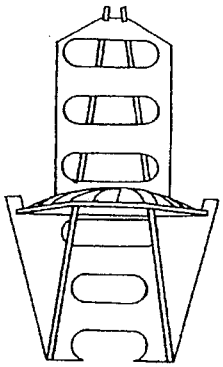

FIGS. 16 to 18 are rear, side, and front elevation views, respectfully, of the fully assembled chair of FIG. 15.

Figure 19:
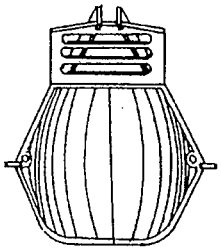
Figure 6:
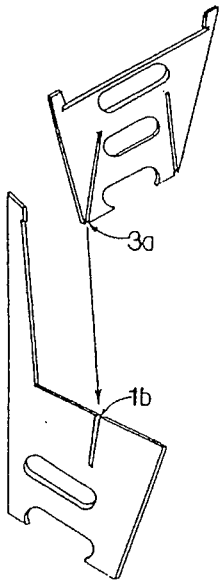
Figure 7:
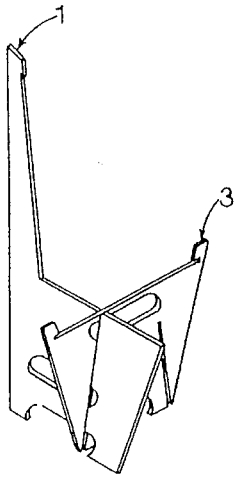
Figure 8:
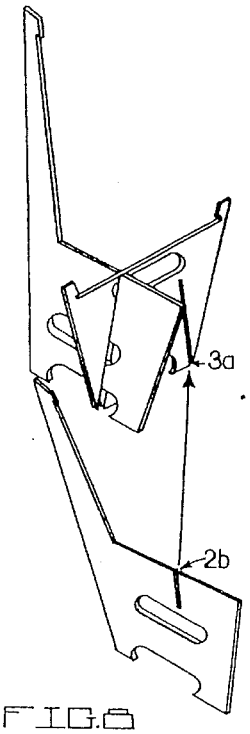

FIG. 19 is a plan view of the assembled chair of FIG. 15.

Figure 3:
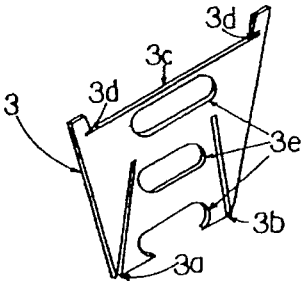
FIG. 3 is perspective view of the brace member which joins the two side pieces to one another.
Figure 9:
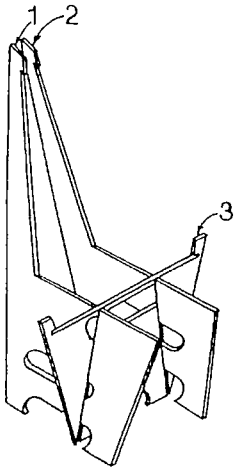
Figure 10:
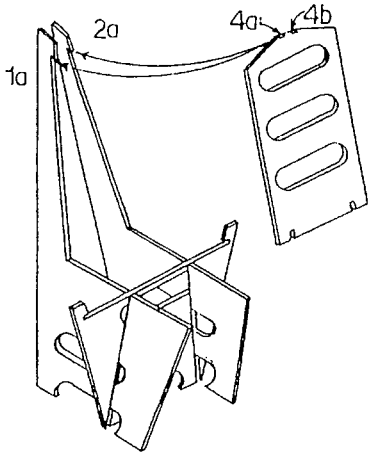
Figure 11:
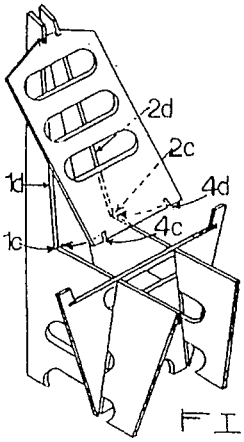
Figure 12:
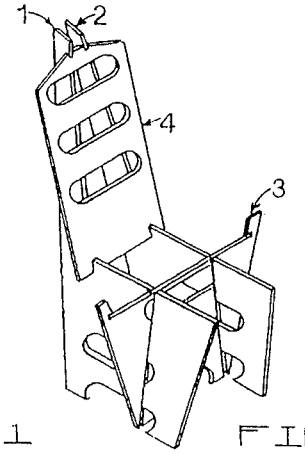

With reference to FIG. 1 to 3 of the drawings, side pieces 1 and 2 and brace 3 form the basic frame of the chair. Each of the side pieces comprise of a seat support portion 1*c* and 2*c*, and a back support portion 1*d* and 2*d*. Side pieces 1 and 2 may be identical, but preferably differ from one another at two portions. The two portions where they differ are seat support portions 1*c* and 2*c* which angle in opposite directions in order to meet flush with seat member 5, and bottom portion 1*f* and 2*f* which angle in opposite directions to meet flush with the ground. Right side piece 1 and left side piece 2 are assembled with brace 3 as follow:

Slots 1*b* and 2*b* of the seat support portion of side pieces 1 and 2 and slots 3*a* and 3*b* in brace 3 cooperate with one another to form a stable platform when the side members are joined with one another by means of brace 3. Assembly of the side members and brace member are illustrated graphically in FIGS. 6 thru 9. After the frame is assembled, as illustrated in FIG. 9, the chair backrest and seat are installed to complete the chair. These members are held in fixed positions on the frame as follows: Hooks 1*a* and 2*a* shown in greater detail in FIG. A1 are provided at the upper ends of the back support portions 1*d*and 2*d* of the side members 1 and 2. The chairs backrest member 4 is proved with notches 4*a* and 4*b*, shown in greater detail in FIG. B1. When the chairs backrest is slipped into place, as illustrated graphically in FIGS. 11 and 12, hooks 1*a* and 2*a* engage slots 4*a* and 4*b*. At the same time, slots 4*c* and 4*d* in the lower part of backrest member 4 engage the top surfaces of the seat support portions 1*c* and 2*c* of side members 1 and 2, wedging the back firmly into fixed position against the backrest portions 1*d* and 2*d* of the side members 1 and 2. When backrest member 4 is fixed firmly into position, it gives the frame members of the chair of this invention extra rigidity and stability.

Figure 13:
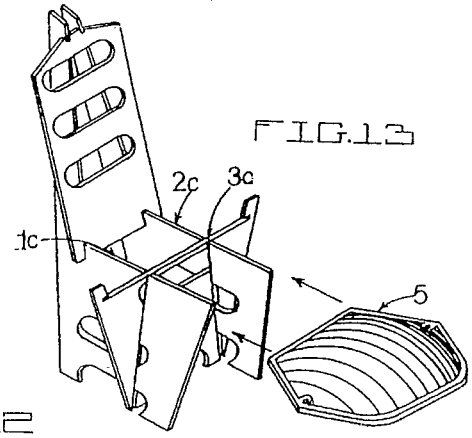

Notched tabs 3*d* at each side of brace member 3 engage edges 5*b* of seat member 5 when it is slid into position on the seat support portions 1*c* and 2*c* of side pieces 1 and 2, and 3*c* of brace member 3 as graphically illustrated in FIGS. 13 thin 15. Non-detachable pegs 5*a* at each side of seat member 5 may be of the same material as specified for the five members of the chair of this invention. They will be sized to fit snugly into the holes in seat member 5. Pieces with larger diameters than the holes with the same materials as the chair are fixed to the top and bottom of the pegs so that the pegs are retained therein. During assembly of the chair of this invention, pegs 5*a* of seat member 5 are kept in the up position as illustrated in FIG. A3. When seat member 5 is in place, as illustrated in FIG. 15, pegs 5*a* are pressed into the down position as illustrated in FIG. B3. In the down position, pegs 5*a* engage the top of the brace member 3, holding the seat firmly in position on the seat supports 1*c* and 2*c*, and on the top surface 3*c* of brace member 3. When seat member 5 and non-detachable pegs 5*a* are in place, they also prevent slots 4*c* and 4*d* of backrest member 4 from possibly sliding out of the top surfaces of seat support portion 1*c* and 2*c*. Curved edges 5*c* and cushion 5*d* are optional, but preferred principally for aesthetic purposes, and also to give extra comfort when the chair of this invention is assembled. Cushion 5*d* also will allow seat member 5 to function as a floor cushion or the like when desired.

FIGS. 15 thru 19 illustrates more clearer how the elliptical cut-out portions 1*e*, 2*e*, 3*e*, and 4*e* function aesthetically when the five members of the chair of this invention are assembled.

I claim:

1. In a take-apart chair of wood, plastic, laminated fiberboard, aluminum or the like comprising a pair of side pieces each having a back support portion and a seat support portion, a backrest adapted to be held in place by said back support portion of said side pieces, a brace member joining said side pieces when the chair is assembled, said brace member extending downwardly to engage a floor supporting surface and a seat having front and back and side edges resting on said seat support portion of said side pieces, the improvement comprising:

a. hooks at the upper ends of said side pieces, b. notches in the upper part of said backrest engaging said hooks, c. notches in the lower portion of said backrest engaging the seat support portion of said side pieces, d. downwardly facing slots in said brace member engaging the seat support portion of said side pieces, e. upwardly facing slots in the seat support portion of said side pieces engaging said brace member, said upwardly facing slots positioned at approximately a midpoint of the seat support portion, f. upwardly extending tabs at each end of said brace member extending beyond said seat and having notches therein engaging the edges of the seat, and g. fastener means holding said seat in position against the backrest locking the seat and backrest in position, the combination insuring structural rigidity of the chair.

2. A chair according to claim 1 provided with a plurality of non-detachable sliding pegs positioned between the backrest and the brace member whereby when the pegs are in a downward position they engage the brace member and the seat is held firmly against the backrest.

* * * * *